US010548415B2

(12) United States Patent
Hirano

(10) Patent No.: US 10,548,415 B2
(45) Date of Patent: Feb. 4, 2020

(54) SHOWCASE AND CONTROL DEVICE

(71) Applicant: Panasonic Intellectual Property Management Co., Ltd., Osaka (JP)

(72) Inventor: Jun Hirano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/354,324

(22) Filed: Nov. 17, 2016

(65) Prior Publication Data

US 2017/0224132 A1 Aug. 10, 2017

(30) Foreign Application Priority Data

Feb. 4, 2016 (JP) ..... 2016-019681

(51) Int. Cl.
*A47F 3/04* (2006.01)

(52) U.S. Cl.
CPC ..... *A47F 3/0447* (2013.01)

(58) Field of Classification Search
CPC ..... A47F 3/0447
See application file for complete search history.

(56) References Cited

U.S. PATENT DOCUMENTS 3,304,736 A * 2/1967 Brennan ..... A47F 3/0447 454/193
3,756,038 A * 9/1973 MacMaster ..... A47F 3/0447 62/256
9,538,858 B2 * 1/2017 Rajagopalan ..... A47F 3/0447
2005/0144963 A1 * 7/2005 Peterson ..... F24F 11/0001 62/178
2006/0042288 A1 * 3/2006 Downs ..... A47F 3/0447 62/256
2006/0255164 A1 * 11/2006 Oppermann ..... F24F 3/14 236/44 C
2008/0016893 A1 * 1/2008 Hayase ..... A47F 3/0426 62/248
2009/0215381 A1 * 8/2009 Swofford ..... A47F 3/0447 454/193
2017/0184334 A1 * 6/2017 Boehringer ..... F25D 23/003

FOREIGN PATENT DOCUMENTS

JP 11014233 A * 1/1999
JP 2008-029410 2/2008

* cited by examiner

*Primary Examiner* — Kun Kai Ma
(74) *Attorney, Agent, or Firm* — McDermott Will & Emery LLP

(57) ABSTRACT

A showcase includes a casing having a front opening through which a product is picked up, a product storage located in the casing, a cold air outlet in a front upper portion of the product storage, and a cold air inlet in a front lower portion of the product storage. Cold air is forced to flow out of the cold air outlet in a downward direction and sucked into the cold air inlet. The showcase further includes an inlet port in the front lower portion of the casing at a position below the cold air inlet, a duct, a discharge port in a side wall of the casing, and an airflow generator that forces air in the duct to flow from the inlet port toward the discharge port. The air is sucked through the inlet port and the air in the duct is discharged through the discharge port.

14 Claims, 6 Drawing Sheets

SHOWCASE AND CONTROL DEVICE

BACKGROUND

1. Technical Field

The present disclosure relates to a showcase and a control device.

2. Description of the Related Art

Stores such as a supermarket and a convenience store generally use showcases having a product storage that displays chilled or frozen products such as groceries. In the showcase, air cooled by a cooler is forced to flow out of a cold air outlet in a front upper portion of the product storage and the air is sucked into a cold air inlet in a front lower portion of the product storage. This configuration suppresses the entry of external air into the product storage through a front opening of the showcase, enabling the products in the product storage to be kept cool. However, in such a case, a difference in temperature between the inside of the showcase, which is exposed to cold air, and the outside of the showcase, which is exposed to external air, may lead condensation on the showcase. Some documents have already disclosed a technique for reducing the occurrence of the condensation.

Japanese Unexamined Patent Application Publication No. 2008-29410, for example, describes that a fan for condensation prevention is disposed so as to force warm air in a machine room of the showcase to flow toward an outer surface of a transparent wall (lateral plate) of the showcase.

SUMMARY

However, the conventional example does not discuss the problem caused when warm air is sent to the side surface of the showcase in the preventive measure against condensation on the side surface of the showcase. In view of the above, one non-limiting and exemplary embodiment of the present disclosure provides a showcase in which condensation on the side surface of the showcase is reduced without using the warm air. In addition, one non-limiting and exemplary embodiment provides a control device that controls the showcase.

In one general aspect, the techniques disclosed here feature a showcase including a casing having a front opening through which a product is picked up, a product storage located in the casing and including a shelf on which the product is displayed, a cold air outlet in a front upper portion of the product storage, and a cold air inlet in a front lower portion of the product storage. Cold air is forced to flow out of the cold air outlet in a downward direction and is sucked into the cold air inlet. The showcase further includes an inlet port in the front lower portion of the casing at a position below the cold air inlet, air being sucked through the inlet port, a duct through which air sucked through the inlet port flows, a discharge port in a side wall of the casing, the air in the duct being discharged through the discharge port, and an airflow generator that forces the air in the duct to flow from the inlet port toward the discharge port.

The showcase according to one general aspect of the present disclosure is able to reduce the condensation on the side surface of the showcase without using warm air.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
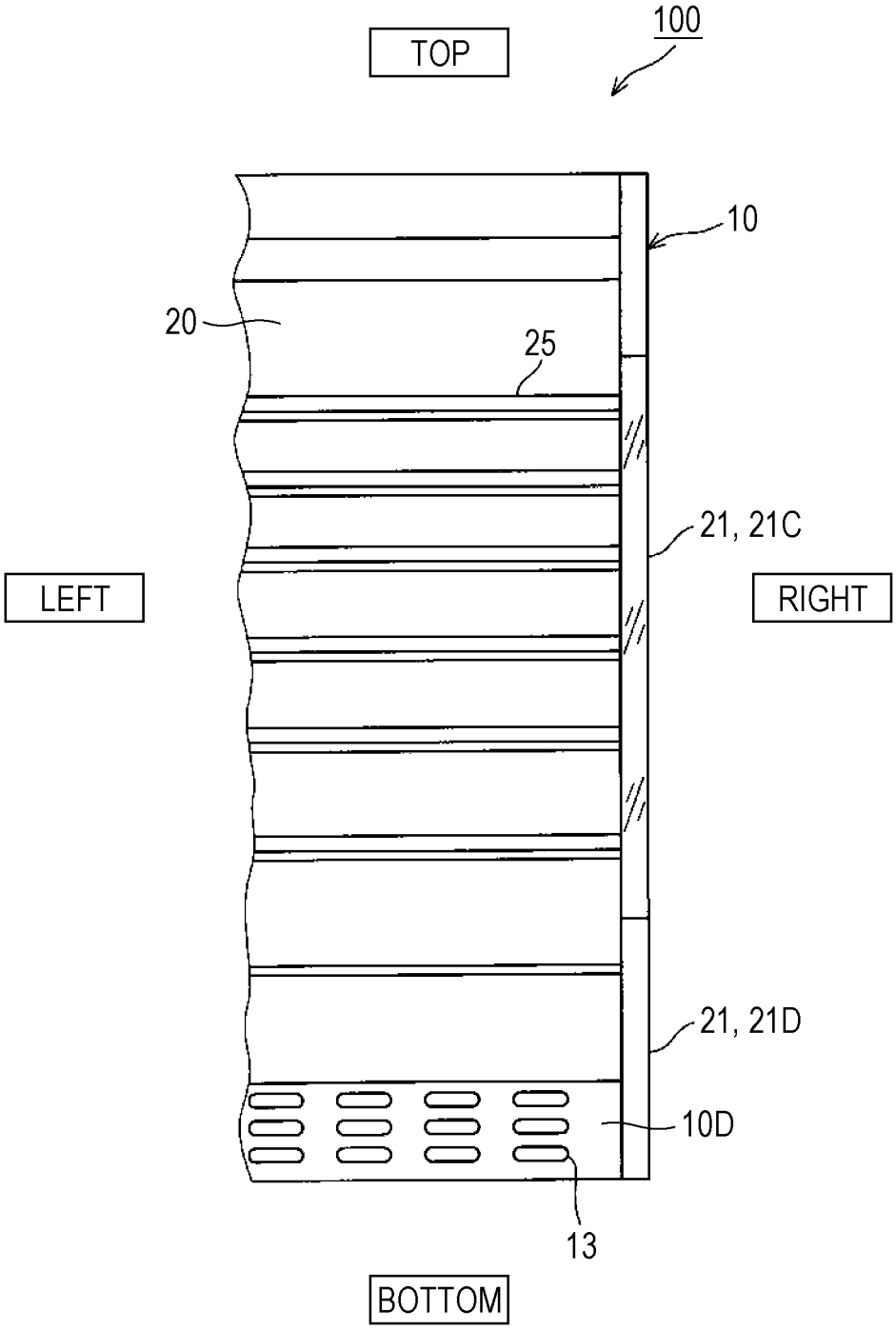
FIG. 1 is a view illustrating an example of a showcase according to a first embodiment.

A comprehensive study was conducted to reduce condensation on a side surface of a showcase, and the following is found as a result of the study.

At first, a cause of the condensation on the side surface of the showcase is explained.

In some cases, a seamless horizontally long showcase cannot be disposed in a store depending on a structure of the store or a kind of product to be displayed, for example. In such a case, a showcase in multiple pieces is used. For example, a fire shutter disposed in the store so as to comply with a regulation may separate the pieces of the showcase at a shuttered position. In addition, products to be displayed in different ranges of storage temperature (products required to be refrigerated and products not required to be refrigerated, for example) may separate the pieces of the showcase at a boundary between the ranges of storage temperature. In addition, in some cases, the showcase is positioned next to an ordinary display rack, which is not the showcase.

In the above-described configuration, the adjacent pieces of showcase or the showcase and the display rack adjacent to each other are likely to be disposed in such a manner that adjacent lateral plates thereof are close to each other. In such a case, the lateral plates of the adjacent pieces of showcase or those of the showcase and the display rack adjacent to each other define a narrow space therebetween where external air is retained. Condensation may occur on outer surfaces of the lateral plates depending on humidity of the external air or difference between a temperature of cold air and a temperature of the external air, and the outer surfaces of the lateral plates may get moldy, for example, due to the condensation. In particular, a showcase having a side wall formed of a glass plate is popular due to its design that enables customers to see products in the showcase through the side wall. However, glass has low heat insulating properties, and thus the condensation readily occurs on the side wall of the showcase formed of glass. The side wall may be a heat insulating glass panel or a double glazed panel, for example, to reduce the condensation. However, this increases the cost of the showcase.

Japanese Unexamined Patent Application Publication No. 2008-29410 therefore discloses a showcase in which the condensation on a side surface of the showcase is reduced by warm air sent to the side surface of the showcase. However, the following problem occurs when the warm air is used to reduce the condensation on the side surface of the showcase.

If the warm air is sent to the side surface of the showcase, the heat of the warm air is transferred to the product storage through the side surface of the showcase. This may adversely affect the cooling state of the products in the product storage. In other words, the preventive measure against condensation disclosed in Japanese Unexamined Patent Application Publication No. 2008-29410 may deteriorate efficiency in cooling the products in the product storage.

In addition, examples of the showcase include a showcase with a built-in refrigerator and a showcase with a separate refrigerator. The showcase with a built-in refrigerator includes a built-in refrigerator (a condenser or a compressor, for example) of a refrigeration cycle. The showcase with a separate refrigerator includes a separately placed refrigerator connected to the showcase with a pipe. In the showcase with a separate refrigerator, warm air is not generated in the showcase. The preventive measure against condensation described in Japanese Unexamined Patent Application Publication No. 2008-29410 is only applicable to the showcase with a built-in refrigerator, but not applicable to the showcase with a separate refrigerator.

In view of the above, the inventors found that cold air flowed to a lower side of the casing without entering a cold air inlet is able to be used in the preventive measure against condensation on the side surface of the showcase.

A showcase according to a first aspect of the present disclosure includes a showcase including a casing having a front opening through which a product is picked up, a product storage located in the casing and including a shelf on which the product is displayed, a cold air outlet in a front upper portion of the product storage, and a cold air inlet in a front lower portion of the product storage. Cold air is forced to flow out of the cold air outlet in a downward direction and is sucked into the cold air inlet. The showcase further includes an inlet port in the front lower portion of the casing at a position below the cold air inlet, air being sucked into the inlet port, a duct through which air sucked through the inlet port flows, a discharge port in a side wall of the casing, the air in the duct being discharged through the discharge port, and an airflow generator that forces the air in the duct to flow from the inlet port toward the discharge port.

With this configuration, the condensation on the side surface of the showcase is reduced without warm air. Thus, the efficiency in cooling the products in the product storage is improved compared to the conventional example in which warm air is sent to the side surface of the showcase to reduce the condensation on the side surface of the showcase. Specifically, air flowed to the lower side of the casing without entering the cold air inlet enters the duct through the inlet port and flows to the discharge port. Then, low enthalpy air, such as low humidity air, low temperature air, and low humidity and low temperature air, is sent toward the side surface of the showcase through the discharge port, reducing the condensation on the side surface of the showcase. This does not adversely affect the cooling state of the products in the product storage, and thus improves the efficiency in cooling the products in the product storage compared to the conventional example.

In addition, the preventive measure against the condensation on the side surface of the showcase according to the first aspect is more versatile than the conventional example. Specifically, the preventive measure against the condensation according to the present aspect is applicable to both of a showcase with a built-in refrigerator and a showcase with a separate refrigerator, since the condensation on the side surface of the showcase is reduced by low enthalpy air, which flowed to the lower side of the casing without entering the cold air inlet.

In the showcase according to a second aspect of the present disclosure according to the first aspect, the discharge port is located in a lower portion of a side wall of the casing.

A region of the side wall of the showcase located above the cold air inlet is readily cooled by cold air in the product storage. Thus, the condensation on the side wall of the casing is more effectively reduced when the discharge port is provided in the lower portion of the side wall of the casing compared to in an upper portion of the side wall of the casing.

Hereinafter, embodiments of the present disclosure are described in detail with reference to the drawings.

The embodiments described below provide general or specific examples. Numbers, shapes, materials, components, positions, and connection of the components described in the following embodiments are examples. The present disclosure is not limited to the embodiments. The components of the following embodiments that are not included in an independent claim, which constitutes the broadest concept of the present disclosure, are optional.

First Embodiment

Figure 2:
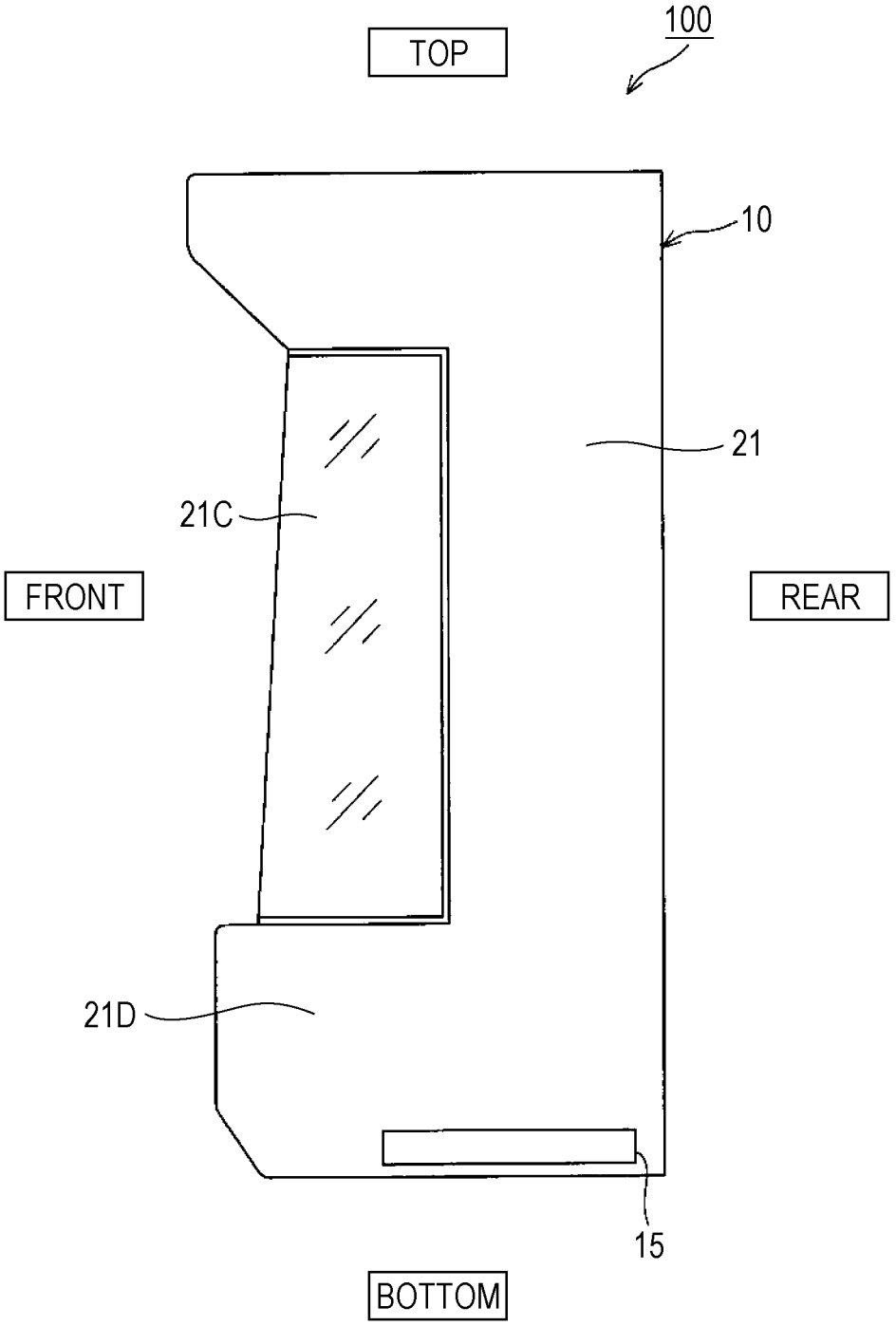
FIG. 2 is a view illustrating the example of the showcase according to the first embodiment.
Figure 3:
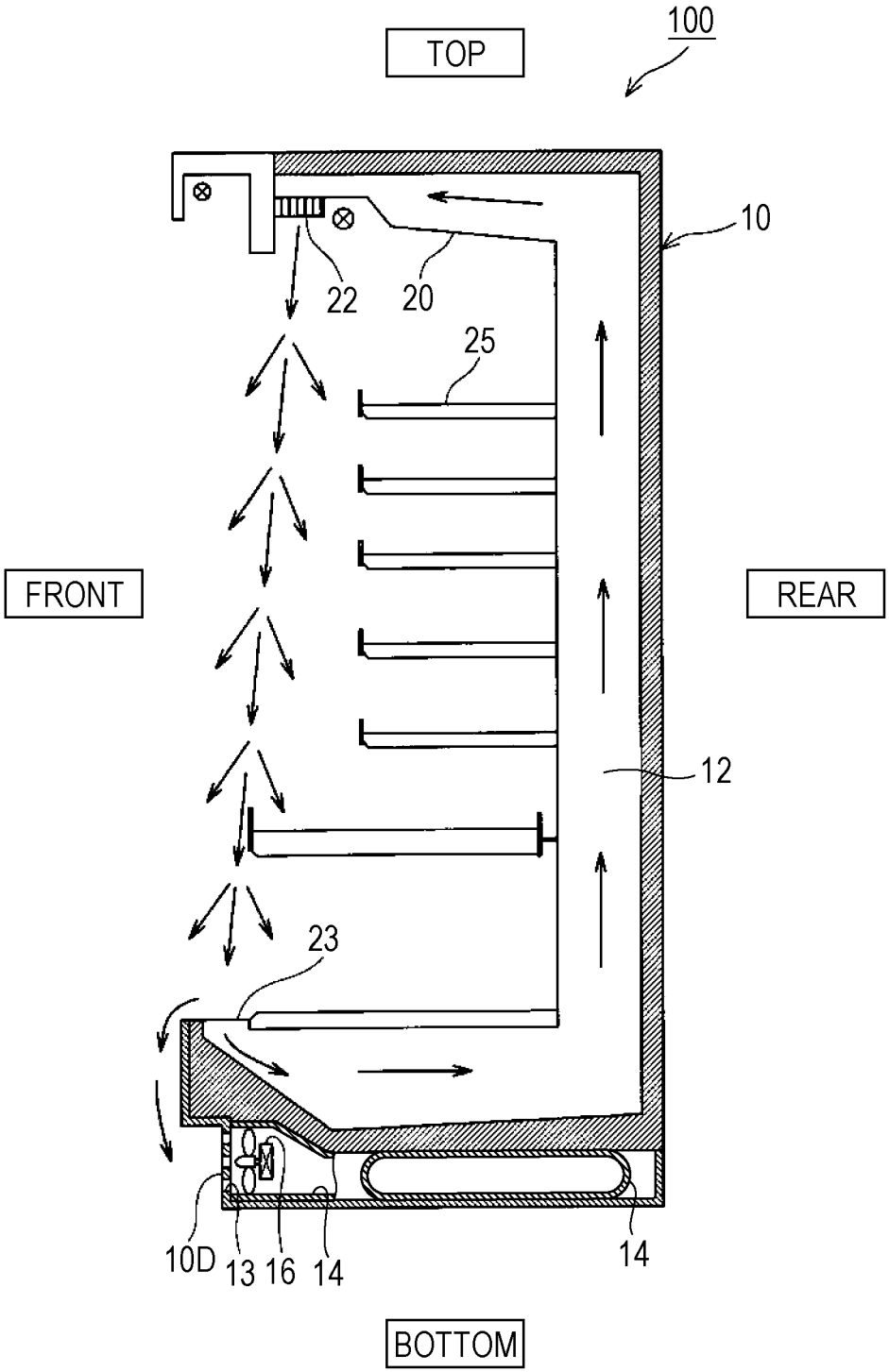
FIG. 3 is a view illustrating the example of the showcase according to the first embodiment.

FIG. 1, FIG. 2 and FIG. 3 are views illustrating an example of a showcase according to a first embodiment. Top, bottom, right, left, front, and rear are defined as indicated in the drawings, and gravity acts from top to bottom. A showcase 100 may be a showcase with a built-in refrigerator or a showcase with a separate refrigerator. Hereinafter, a showcase with a separate refrigerator is described. Well-known components and devices such as a lighting device, an electric motor, and a thermometer included in the showcase 100 are not described.

FIG. 1 is a front view of the showcase 100. FIG. 2 is a right side view of the showcase 100. A left side view of the showcase 100 is similar to FIG. 2. FIG. 3 is a side view of the showcase 100 in which a side wall 21 of a casing 10 is removed.

As illustrated in FIG. 1, the showcase 100 includes a casing 10 and a product storage 20.

The casing 10 has a front opening through which products in the product storage 20 are picked up. Specifically, the showcase 100 is an open showcase, which does not has a door on the front side. The open showcase allows a customer to readily pick up a product from the product storage 20 compared to a closed showcase. However, external air flows into the product storage 20 through the opening of the open showcase. To solve the problem, an air curtain formed of cold air, for example, is provided over the opening. The air curtain is described later in detail.

The product storage 20 is located in the casing 10 and includes shelves 25 on which products (not illustrated) are displayed. In this embodiment, as illustrated in FIG. 2, a middle portion 21C of the side wall 21 of the showcase 100 is formed of a transparent member (a glass plate, for example). The middle portion 21C of the side wall 21 formed of the transparent plate, for example, enables a customer to see the inside of the showcase 100 through the side wall 21, which is considered as high-quality design. However, the showcase 100 according to the present embodiment is not limited to this configuration. The entire side wall 21 may be formed of an opaque member.

As illustrated in FIG. 3, the showcase 100 includes a cold air outlet 22 and a cold air inlet 23.

The cold air outlet 22 is disposed in a front upper portion of the product storage 20 and the cold air is forced to flow out of the cold air outlet 22 in a downward direction. The cold air inlet 23 is disposed in a front lower portion of the product storage 20 and the cold air is sucked into the cold air inlet 23.

The cold air outlet 22 may have any configuration as long as the cold air is forced to flow out of the cold air outlet 22 in the downward direction. The cold air inlet 23 may have any configuration as long as the cold air is sucked into the cold air inlet 23.

A cooler in a refrigeration cycle (not illustrated) and an airflow generator (not illustrated) for circulation of cold air, for example, may be disposed in an inner duct 12 of the casing 10, and a honeycomb flow straightener (not illustrated) may be disposed in the cold air outlet 22. For example, the airflow generator is a fan. With this configuration, the air (cold air) cooled by the cooler flows through the inner duct 12 and is straightened by the flow straightener in the cold air outlet 22. Then, the cold air flows downward along a front end of each shelf 25 and is sucked into the cold air inlet 23. Thus, the air curtain formed of the cold air is formed over the opening of the showcase 100. The air curtain interrupts or prevents communication of air between the product storage 20 and a space outside the product storage 20, enabling the temperature of the products in the product storage 20 to be maintained in a proper temperature range.

In this embodiment, as illustrated in FIGS. 1, 2, and 3, the showcase 100 further includes an inlet port 13, a duct 14, a discharge port 15, and an airflow generator 16.

The inlet port 13 is provided in a front lower portion 10D of the casing 10 at a position below the cold air inlet 23. The inlet port 13 is an opening through which the air is sucked. The inlet port 13 may have any configuration as long as the inlet port 13 is an opening provided in the front lower portion 10D of the casing 10 at a position below the cold air inlet 23 and air is sucked into the inlet port 13. For example, the inlet port 13 may be a hole in a kick plate constituting the front lower portion 10D or may be a metal mesh in the kick plate.

The duct 14 is a passage through which the air sucked through the inlet port 13 flows. The air sucked through the inlet port 13 is sent to the discharge port 15 through the duct 14. For example, the duct 14, which extends from the inlet port 13 to the discharge port 15, may be a bent tube in a top view of the showcase 100.

The discharge port 15 is provided in the side wall 21 of the casing 10. The discharge port 15 is an opening through which the air in the duct 14 is discharged. As illustrated in FIG. 2, the discharge port 15 may be disposed in a lower portion 21D of a side wall of the casing 10. The lower portion 21D of the side wall of the casing 10 may be located below the cold air inlet 23.

The discharge port 15 may have any configuration as long as the discharge port 15 is an opening located in the side wall 21 of the casing 10 and the air in the duct 14 is discharged through the discharge port 15. For example, the discharge port 15 may be a hole in a plate constituting the side wall 21 or may be a metal mesh in the plate.

The airflow generator 16 is an air blower that forces air in the duct 14 to flow from the inlet port 13 toward the discharge port 15. The airflow generator 16 may have any configuration that is able to force the air in the duct 14 to flow from the inlet port 13 toward the discharge port 15. The airflow generator 16 may be an air suction device disposed so as to face the inlet port 13 or may be an air exhaust device disposed so as to face the discharge port 15. Examples of the air suction device and the air exhaust device include a fan and a blower.

As indicated by arrows in FIG. 3, some cold air flowed out of the cold air outlet 22 is not sucked into the cold air inlet 23 and flows to the front lower portion 10D of the casing 10 positioned below the cold air inlet 23. Thus, the cold air, which did not enter the cold air inlet 23, is likely to remain near the kick plate constituting the front lower portion 10D while the showcase 100 is in operation (while the cold air is flowing from the cold air outlet 22). Thus, the cold air is highly likely to flow into the duct 14 and low enthalpy air (low humidity air, low temperature air, or low humidity and low temperature air, for example) is highly likely to be discharged through the discharge port 15.

With the above-described configuration, in the showcase 100 according to the present embodiment, the condensation on the side wall 21 of the casing 10 is reduced without using warm air.

With this configuration, in the preventive measure against the condensation on the side wall 21 of the casing 10, the efficiency in cooling the products in the product storage 20 is improved compared to the conventional example in which warm air is sent to the side surface of the showcase. Specifically, low enthalpy air, which flowed to a lower side of the casing 10 without entering the cold air inlet 23, flows through the duct 14 from the inlet port 13 toward the discharge port 15. Then, the low enthalpy air flows from the discharge port 15 toward the side wall 21 of the casing 10, reducing the occurrence of condensation on the side wall 21 of the casing 10. This does not adversely affect the efficiency in cooling the products in the product storage 20, and thus improves the cooling efficiency of the products in the product storage 20 compared to the conventional example.

In addition, this configuration expands versatility of the preventive measure against the condensation on the side wall 21 of the casing 10 compared to the conventional example. Specifically, since the occurrence of the condensation on the side wall 21 of the casing 10 is reduced by using the low enthalpy air, which flowed to the lower side of the casing 10 without entering the cold air inlet 23, the preventive measure against the condensation according to this embodiment, is applicable to both of a showcase with a built-in refrigerator and a showcase with a separate refrigerator.

In addition, a region of the side wall 21 of the casing 10 located above the cold air inlet 23 is readily cooled by the cold air in the product storage 20. Thus, the condensation on the side wall 21 of the casing 10 is more effectively reduced when the discharge port 15 is provided in the lower portion 21D of the side wall of the casing 10 compared to in an upper portion of the side wall of the casing 10. In addition, the discharge port 15 in the lower portion 21D of the side wall of the casing 10 may be configured to discharge the air in an upward direction.

In particular, if the middle portion 21C of the side wall 21 of the casing 10 is formed of a transparent member such as a glass plate, condensation readily occurs on the middle portion 21C of the side wall 21. However, the above-described configuration properly reduces the occurrence of the condensation on the middle portion 21C formed of a transparent member.

Since a region of the side wall 21 of the casing 10 located below the cold air outlet 22 is readily cooled, the discharge port 15 may be provided in a portion of the side wall 21 of the casing 10 at a position above the cold air outlet 22. In such a case, the discharge port 15 may be configured to discharge air in a downward direction.

First Example

Figure 4:
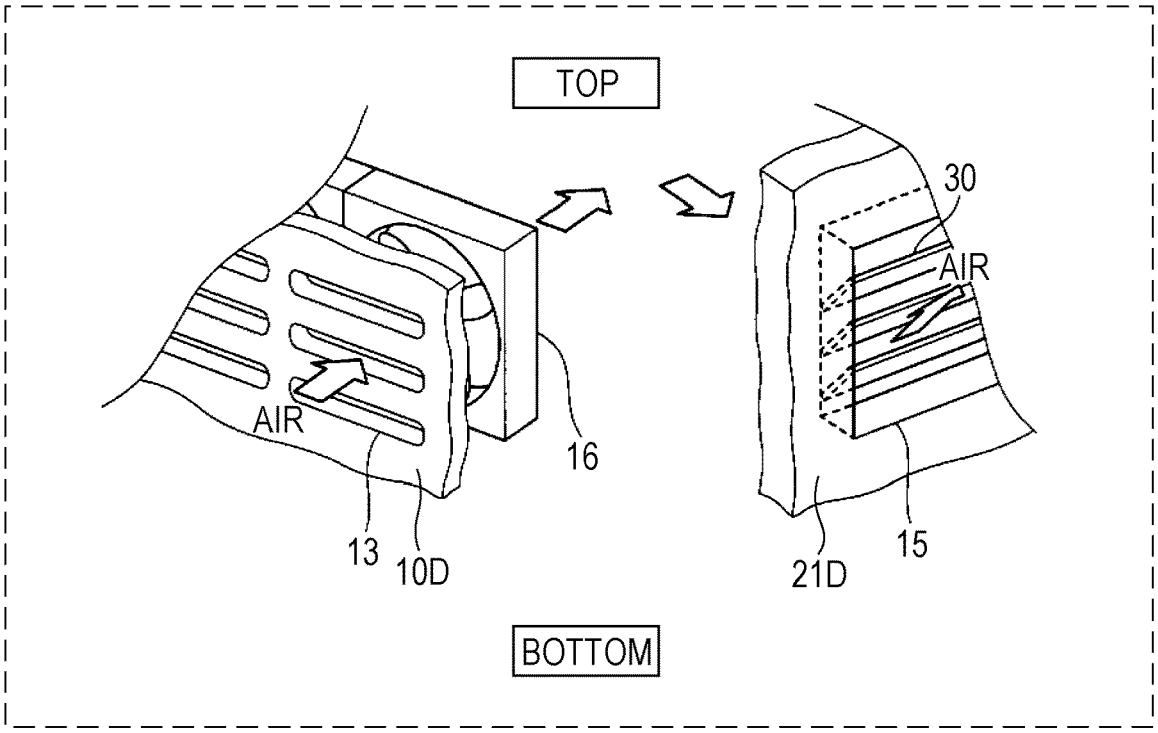
FIG. 4 is a view illustrating an example of a showcase according to a first example of the first embodiment.

FIG. 4 illustrates an example of a showcase according to a first example of the first embodiment. In FIG. 4, a configuration of the front lower portion 10D of the showcase 100, a configuration of the lower portion 21D of a right side wall, and directions of airflow are indicated. The duct 14 illustrated in FIG. 3 is not illustrated in FIG. 4 for simplification.

The showcase 100 according to the first example of the first embodiment includes a fin 30 in the discharge port 15 in addition to the components of the showcase 100 according to the first aspect or the second aspect. The fin 30 includes inclined portions that guide the air passing through the fin 30 in an upward direction.

With this configuration, a direction of flow of the air passing through the discharge port 15 is changed to an upward direction by the inclined portions of the fin 30. Thus, airflow along the side wall 21 of the casing 10 is generated above the discharge port 15. This effectively reduces the occurrence of the condensation on the side wall 21 of the casing 10 compared to the case in which the fin 30 having the above-described configuration is not disposed in the discharge port 15.

The configurations of the showcase 100 of this example other than the above-described configuration may be identical to those of the showcase 100 according to the first aspect or the second aspect.

Second Example

Figure 5:
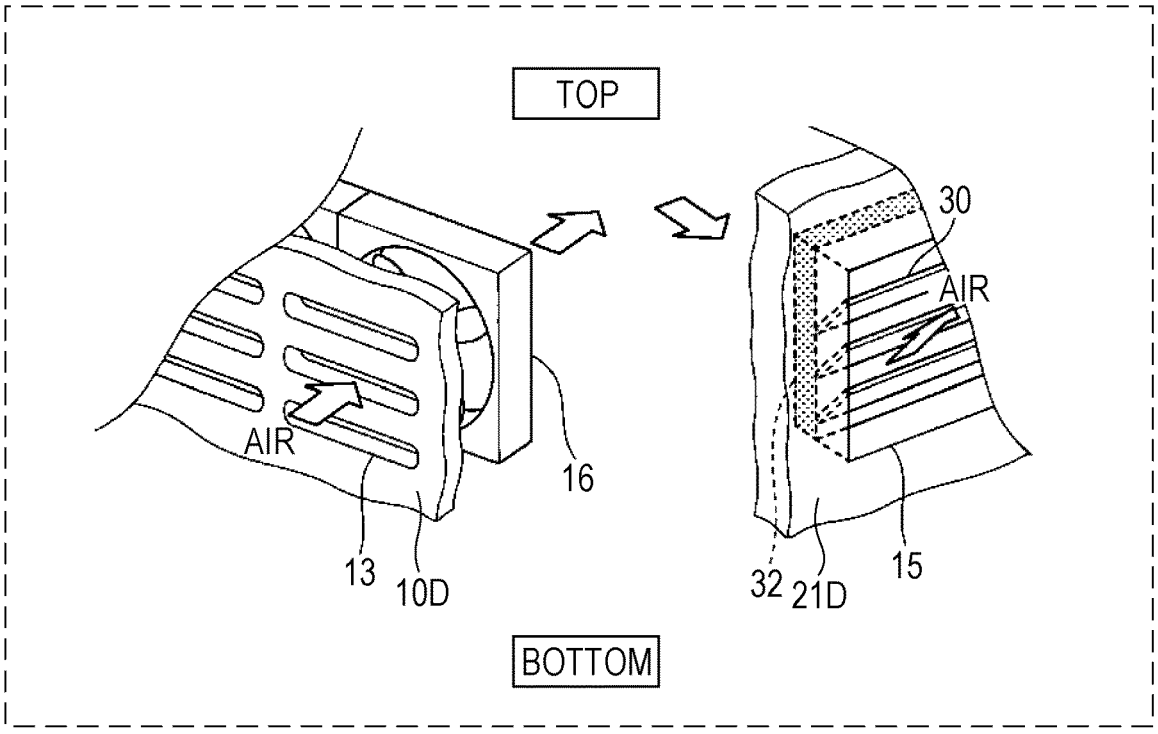
FIG. 5 is a view illustrating an example of a showcase according to a second example of the first embodiment.

FIG. 5 illustrates an example of a showcase according to a second example of the first embodiment. In FIG. 5, a configuration of the front lower portion 10D of the showcase 100, a configuration of the lower portion 21D of a right side wall, and directions of airflow are indicated. The duct 14 illustrated in FIG. 3 is not illustrated in FIG. 5 for simplification.

The showcase 100 of the second example of the first embodiment includes a filter 32 in at least one of the inlet port 13 and the discharge port 15 in addition to the components of the showcase 100 according to any one of the first aspect, the second aspect, and the first example.

With this configuration, particles in the air passing through the duct 14 are reliably removed by the filter 32.

FIG. 5 illustrates the configuration having the filter 32 in the discharge port 15 in which the fin 30 is disposed. However, the configuration of the second example is not limited to this. For example, the showcase 100 may include the filter 32 in the inlet port 13 or may include the filter 32 in each of the inlet port 13 and the discharge port 15. In addition, the showcase 100 may include a mesh member in at least one of the inlet port 13 and the discharge port 15 to prevent a foreign substance from entering the duct 14. In addition, the fin 30 in the discharge port 15 of the showcase 100 is an optional component.

The configurations of the showcase 100 of this example other than the above-described configuration may be identical to those of the showcase 100 according to the first aspect or the second aspect.

Second Embodiment

Figure 6:
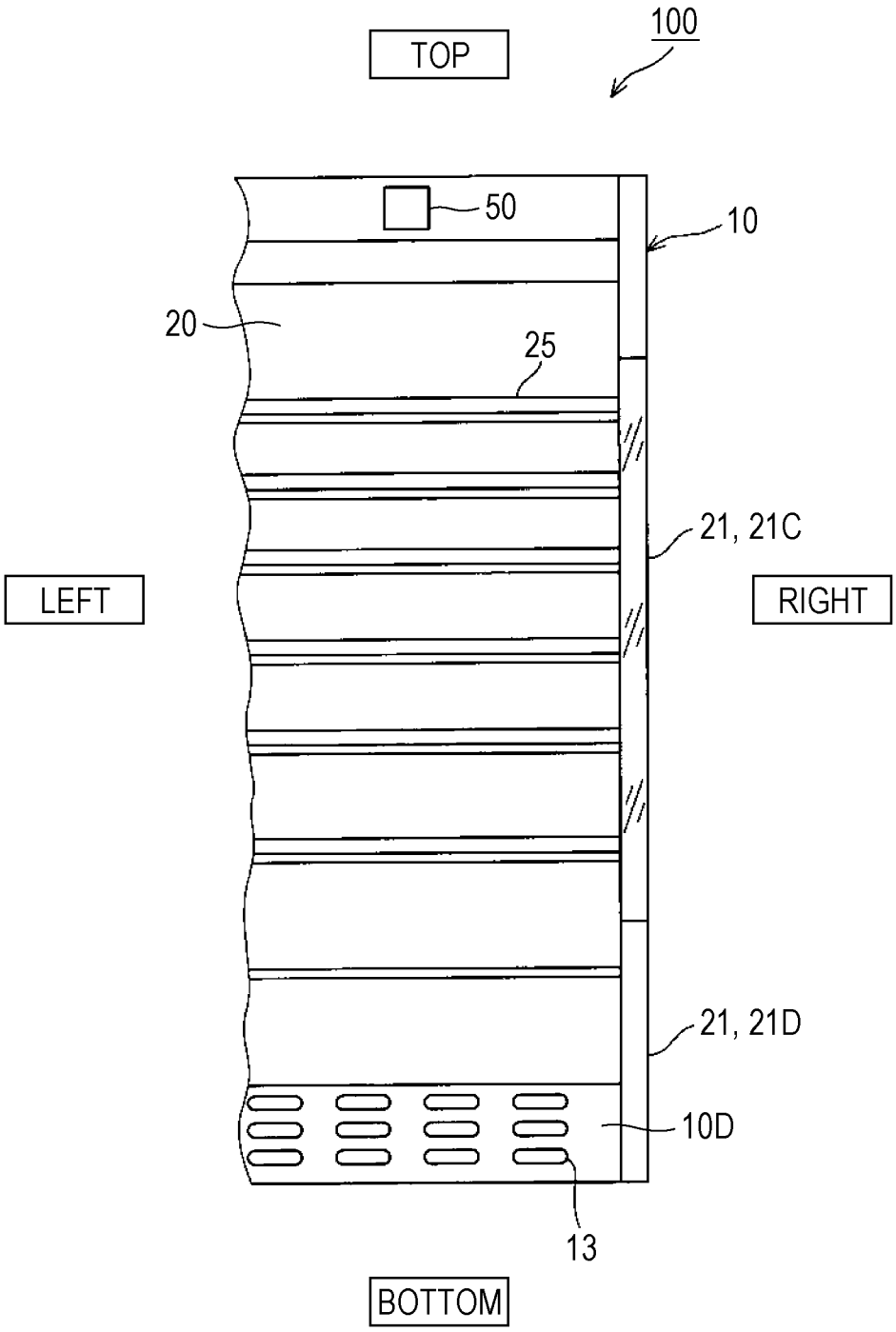
FIG. 6 is a view illustrating an example of a showcase according to a second embodiment.

FIG. 6 is a view illustrating an example of a showcase according to a second embodiment.

A showcase 100 according to the second embodiment includes a controller 50 that controls an operation of the airflow generator 16, in addition to the components of the showcase 100 according to any one of the first aspect, the second aspect, the first example of the first embodiment, and the second example of the first embodiment.

As illustrated in FIG. 6, the controller 50 is disposed in the showcase 100 and is configured to control the operation of the airflow generator 16.

A humidity environment in the showcase 100 is in a second state in some cases. Humidity in the showcase 100 is higher in the second state than in a first state. In such a case, the controller 50 may increase an amount of work of the airflow generator 16. In other words, the controller 50 may control the operation of the airflow generator 16 in such a manner that the flow rate of the air passing through the duct 14 is increased when the humidity environment in the showcase 100 is in the second state in which the humidity in the showcase 100 is higher than in the first state. In this configuration, since the amount of work of the airflow generator 16 is increased when the humidity environment is changed to the second state in which the condensation more readily occurs on the side wall 21 of the casing 10 than in the first state, waste power consumption of the airflow generator 16 is reduced.

The condensation may readily occur in various humidity environments. For example, condensation readily occurs in summer than in winter. In addition, condensation readily occurs in a rainy day than in a sunny day. Thus, the controller 50 may increase the amount of work of the airflow generator 16 only during a high humidity period in which the condensation readily occurs by using a timer function or a calendar function of the controller 50 or by a remote monitoring system or a remote operation by a user, for example. For example, the controller 50 may increase the amount of work of the airflow generator 16 in summer compared to that in winter by using the calendar function of the controller 50. In addition, the controller 50 may increase the amount of work of the airflow generator 16 in a rainy day compared to that in a sunny day by the remote operation by a user.

In addition, the controller 50 may detect the humidity environment in the showcase 100 and control the amount of work of the airflow generator 16. The controller 50 may employ any method to detect the humidity environment. The controller 50 may use a hygrometer located at a predetermined position in the showcase 100 to directly determine the humidity environment, or may use a hygrometer located at a predetermined position correlated with the humidity environment in the showcase 100 (a hygrometer for monitoring an internal environment of the store, for example) to indirectly determine the humidity environment in the showcase 100. In addition, any value correlated with the humidity environment in the showcase 100 (temperature, for example) may be used to indirectly determine the humidity environment in the showcase 100.

When the showcase 100 is in a defrosting operation, the controller 50 may decrease the amount of work of the airflow generator 16. "Decrease the amount of work of the airflow generator 16" includes a situation in which the amount of work of the air flow generator 16 decreases to zero by stopping an operation of the airflow generator 16.

The controller 50 may control the operation of the airflow generator 16 in connection with a timer-controlled defrosting operation on the showcase 100, for example.

In other words, while the defrosting operation is being performed on a cooler in the refrigeration cycle, the air flowing through the duct 12 is less cooled by the cooler, and thus the amount of cold air flowing downward without entering the cold air inlet 23 is small. In addition, the product storage 20 is less cooled and the difference in temperature between the inside of the casing 10 and the outside of the casing 10 is small. Thus, the condensation is less likely to occur on the side wall 21 of the casing 10. When the showcase 100 is in the defrosting operation, the waste power consumption of the airflow generator 16 is able to be reduced by decreasing the amount of work of the airflow generator 16.

The controller 50 may decrease the amount of work of the airflow generator 16 at night compared to that during daytime. The showcase 100 is covered with a night cover at night in some cases. In such a case, a small amount of cold air flows downward without entering the cold air inlet 23. Thus, the waste power consumption of the airflow generator 16 is reduced by decreasing the amount of work of the airflow generator 16 at night compared to that during daytime.

Alternatively, the controller 50 may increase the amount of work of the airflow generator 16 at night compared to that during daytime. Air conditioning equipment of the store may stop at night, and the showcase 100 may be in a humidity environment in which condensation readily occurs at night compared to during daytime. In such a case, the controller 50 increases the amount of work of the airflow generator 16 at night compared to that during daytime to reliably reduce the occurrence of the condensation on the side wall 21 of the casing 10.

The controller 50 may have any configuration that has a control function. For example, the controller 50 includes an arithmetic circuit (not illustrated) and a memory circuit (not illustrated) that stores a control program. Examples of the arithmetic circuit include MPU and CPU. An example of the memory circuit includes a memory. The controller 50 may include a single controller that performs centralized control or may include a plurality of controllers that perform decentralized control in cooperation with each other.

The controller 50 activates the airflow generator 16 when the arithmetic circuit of the controller 50 retrieves the control program from the memory circuit. The above-described operations of the airflow generator 16 may be combined if they do not exclude each other.

Modification

Figure 7:
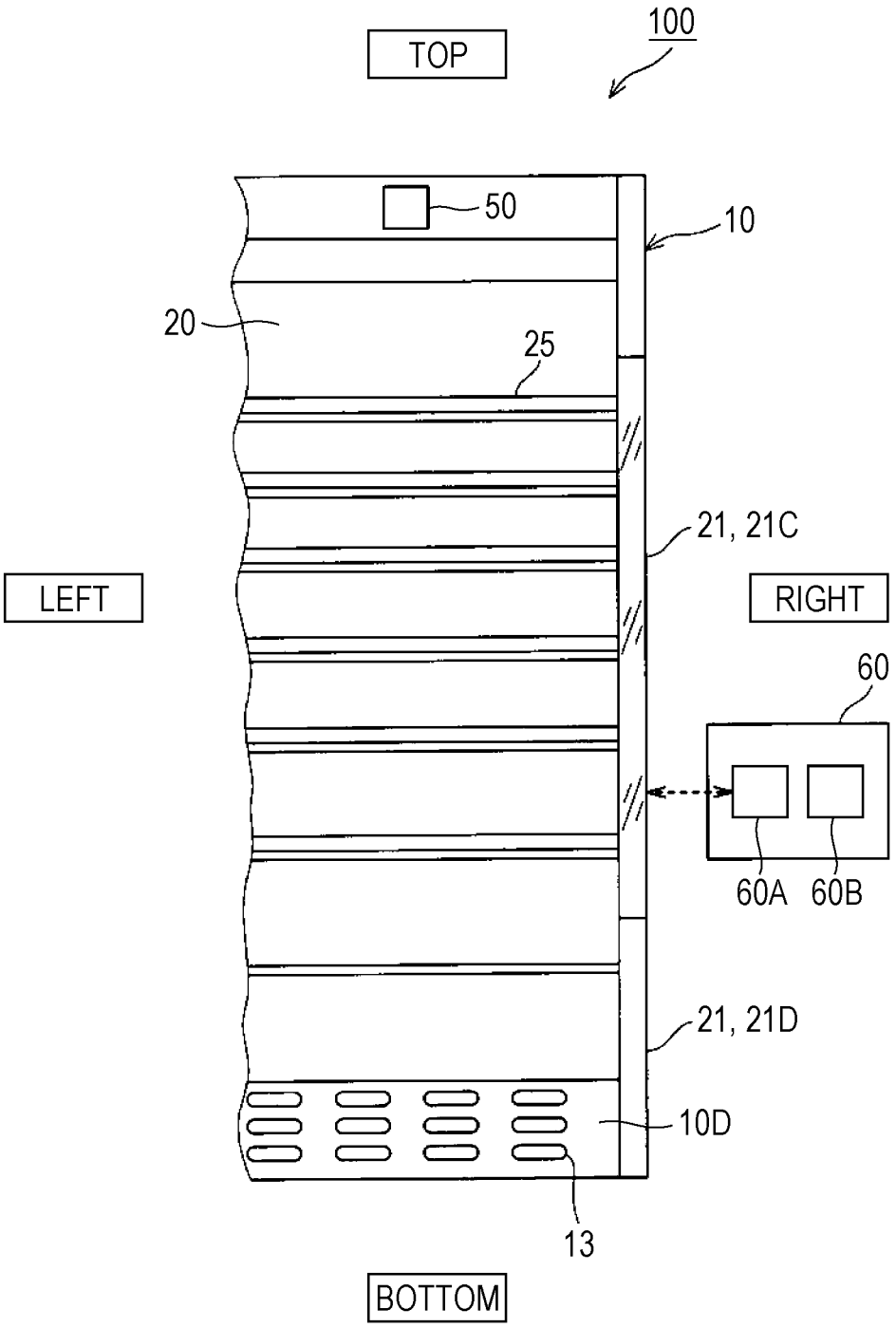
FIG. 7 is a view illustrating a control device according to a modification of the second embodiment.

FIG. 7 is a view illustrating an example of a control device according to a modification of the second embodiment.

A control device 60 according to the modification of the second embodiment includes a transmitter 60A that transmits a control signal for controlling the airflow generator 16 to the showcase 100 according to any one of the first aspect, the second aspect, the first example of the first embodiment, and the second example of the first embodiment, and a controller 60B that controls the transmitter 60A.

As illustrated in FIG. 7, the control device 60 is disposed outside the showcase 100. The controller 60B is connected to the controller 50 in the showcase 100 so as to enable communication between the controller 60B and the controller 50 through the transmitter 60A. The controller 60B is also configured to control an operation of the airflow generator 16. The communication through the transmitter 60A may be wireless network communication or wired network communication.

A humidity environment in the showcase 100 is in a second state in some cases. Humidity in the showcase 100 is higher in the second state than in a first state. In such a case, the controller 60B may cause the transmitter 60A to transmit a control signal for increasing an amount of work of the airflow generator 16. In addition, the controller 60B may cause the transmitter 60A to transmit a control signal for decreasing the amount of work of the airflow generator 16 when the showcase 100 is in a defrosting operation. In addition, the controller 60B may cause the transmitter 60A to transmit a control signal for decreasing the amount of work of the airflow generator 16 at night compared to that during daytime. In addition, the controller 60B may cause the transmitter 60A to transmit a control signal for increasing the amount of work of the airglow generator 16 at night compared to that during daytime.

The detailed operation of the airflow generator 16 by the controller 60B is the same as the operation of the airflow generator 16 by the controller 50, and the description thereof is omitted. As in the case of the controller 50, the controller 60B may have any configuration that has a control function.

A person skilled in the art readily may achieve modifications and other embodiments of the present disclosure from the above description. The above description should be understood as one of examples. The above description is given as teaching of aspects of the present disclosure for those skilled in the art. Various modifications may be applied to the structure and/or the details of functions without departing from the gist of the present disclosure.

An aspect of the present disclosure is applicable to a showcase.

What is claimed is:

1. A showcase comprising:

a casing having a front opening through which a product is picked up;

a product storage located in the casing and including a shelf on which the product is displayed;

a cold air outlet in a front upper portion of the product storage, cold air being forced to flow out of the cold air outlet in a downward direction;

a cold air inlet in a front lower portion of the product storage, the cold air being sucked into the cold air inlet;

an inlet port in the front lower portion of the casing at a position below the cold air inlet, the cold air being sucked through the inlet port;

a duct through which the cold air sucked through the inlet port flows;

a discharge port in a side wall of the casing including a fin with an inclined portion; and an airflow generator that forces the cold air in the duct to flow from the inlet port toward the discharge port, wherein the side wall defines one of a left-side and right-side of the casing when viewed from a front of the casing, wherein the airflow generator controlled by a controller and the inclined portion of the fin allow the cold air flow to the side wall thereby reducing or preventing the condensation on the side wall of the casing, and wherein, based on a humidity of an external air and a temperature difference between the external air and the cold air inside the casing, the controller decreases an amount of work of the airflow generator to allow that the cold air flowing through the duct is less cooled and the amount of cold air flowing downward is small to prevent the condensation.

2. The showcase according to claim 1, wherein the discharge port is located in a lower portion of the side wall of the casing.

3. The showcase according to claim 1, wherein the discharge port includes the inclined portion allowing the air flowing along the fin to flow in an upward direction.

4. The showcase according to claim 1, wherein a filter is provided in at least one of the inlet port and the discharge port.

5. The showcase according to claim 1, wherein the controller increases an amount of work of the airflow generator when a humidity environment in the showcase is in a second state, the humidity environment in the showcase being higher in the second state than in a first state.

6. The showcase according to claim 1, wherein the controller decreases an amount of work of the airflow generator when the showcase is in a defrosting operation.

7. The showcase according to claim 1, wherein the controller decreases an amount of work of the airflow generator at night compared to that during daytime.

8. The showcase according to claim 1, wherein the controller increases an amount of work of the airflow generator at night compared to that during daytime.

9. The showcase according to claim 1, wherein the discharge port is located in a lower portion of the side wall of the casing at a position below the cold air inlet.

10. A control device for a showcase, comprising:

a transmitter that transmits a control signal to the showcase to control an airflow generator of the showcase; and a controller that controls the transmitter, wherein the showcase includes:

a casing having a front opening through which a product is picked up;

a product storage located in the casing and including a shelf on which the product is displayed;

a cold air outlet in a front upper portion of the product storage, cold air being forced to flow out of the cold air outlet in a downward direction;

a cold air inlet in a front lower portion of the product storage, the cold air being sucked into the cold air inlet;

an inlet port in the front lower portion of the casing at a position below the cold air inlet, the cold air being sucked through the inlet port;

a duct through which the cold air sucked through the inlet port flows;

a discharge port in a side wall of the casing including a fin with an inclined portion; and the airflow generator that forces the cold air in the duct to flow from the inlet port toward the discharge port, wherein the side wall defines one of a left-side and right-side of the casing when viewed from a front of the casing, wherein the airflow generator controlled by a controller and the inclined portion of the fin allow the cold air flow to the side wall thereby reducing or preventing the condensation on the side wall of the casing, and wherein, based on a humidity of an external air and a temperature difference between the external air and the cold air inside the casing, the controller decreases an amount of work of the airflow generator to allow that the cold air flowing through the duct is less cooled and the amount of cold air flowing downward is small to prevent the condensation.

11. The control device according to claim 10, wherein the controller causes the transmitter to transmit a control signal for increasing an amount of work of the airflow generator when a humidity environment in the showcase is in a second state, the humidity environment in the showcase being higher in the second state than in a first state.

12. The control device according to claim 10, wherein the controller causes the transmitter to transmit a control signal for decreasing an amount of work of the airflow generator when the showcase is in a defrosting operation.

13. The control device according to claim 10, wherein the controller causes the transmitter to transmit a control signal for decreasing an amount of work of the airflow generator at night compared to that during daytime.

14. The control device according to claim 10, wherein the controller causes the transmitter to transmit a control signal for increasing an amount of work of the airflow generator at night compared to that during daytime.

* * * * *